US008533876B2

(12) United States Patent
Bonk

(10) Patent No.: US 8,533,876 B2
(45) Date of Patent: Sep. 17, 2013

(54) BEDSIDE PISTOL SUPPORTING DEVICE

(76) Inventor: David L. Bonk, North Prairie, WI (US)

( * ) Notice: Subject to any disclaimer, the term of this patent is extended or adjusted under 35 U.S.C. 154(b) by 61 days.

(21) Appl. No.: 13/176,997

(22) Filed: Jul. 6, 2011

(65) Prior Publication Data

US 2012/0006967 A1 Jan. 12, 2012

Related U.S. Application Data

(60) Provisional application No. 61/362,096, filed on Jul. 7, 2010.

(51) Int. Cl.
*A47C 21/00* (2006.01)

(52) U.S. Cl.
USPC ..... 5/503.1; 5/658; 5/659; 248/218.4; 248/309.2; 42/70.11

(58) Field of Classification Search
USPC ..... 248/218.4, 309.2; 5/503.1, 658, 5/659; 42/70.11; 211/64, 59.1
See application file for complete search history.

(56) References Cited

U.S. PATENT DOCUMENTS

| | | | | |
|---|---|---|---|---|
| 1,113,530 | A | 10/1914 | Audley | |
| 1,148,776 | A | 8/1915 | Hubbard | |
| 1,579,552 | A | 4/1926 | Ludlow | |
| 1,589,521 | A | 6/1926 | England | |
| 1,686,002 | A | 10/1928 | Herzon | |
| 1,964,035 | A | 6/1934 | Cross | |
| 1,969,258 | A | 7/1934 | Cross | |
| 2,060,543 | A | 11/1936 | White | |
| 2,216,876 | A | 10/1940 | Crum | |
| 2,557,674 | A | 6/1951 | McRae | |
| 2,655,298 | A | 10/1953 | Riley | |
| 2,998,885 | A | 9/1961 | Surface | |
| 3,637,180 | A | 1/1972 | Parry | |
| 3,718,240 | A | 2/1973 | Rose | |
| 3,796,358 | A | 3/1974 | Grubb | |
| 4,461,442 | A | 7/1984 | Keenan | |
| 4,521,930 | A | 6/1985 | Henson | |
| 4,569,144 | A | 2/1986 | Thurber | |
| 4,691,396 | A | 9/1987 | Hoffman | |
| 4,788,838 | A | 12/1988 | Cislo | |
| 4,846,384 | A | 7/1989 | Perry | |
| 4,934,574 | A | 6/1990 | Salandre | |
| 5,111,545 | A | 5/1992 | Krozal | |
| 5,284,281 | A | 2/1994 | Nichols | |
| D357,398 | S | 4/1995 | Osbern | |
| 5,419,474 | A | 5/1995 | Marx et al. | |
| D359,439 | S | 6/1995 | Osbern | |
| 5,503,276 | A * | 4/1996 | Pierce | 211/64 |
| 5,573,157 | A | 11/1996 | Mauriello et al. | |
| 5,732,914 | A | 3/1998 | Flinn | |
| 5,768,816 | A | 6/1998 | Rassias | |

(Continued)

*Primary Examiner* — Nkeisha Smith
(74) *Attorney, Agent, or Firm* — Boyle Fredrickson, S.C.

(57) ABSTRACT

A pistol supporting device having a base and a support post. The base is shaped to be disposed between a mattress and a box spring so that the base is maintained in a generally horizontal orientation. The support post is constructed of a material that is softer than the material of the bore of a pistol and is preferably formed of a carbon fiber material. The support post is attached to the base and extends in a direction that crosses, but is not perpendicular to, a plane associated with the base. The support post is constructed to be received in a bore of a pistol and oriented to align a grip of the pistol with a palm of a prone user.

11 Claims, 14 Drawing Sheets

(56) References Cited

U.S. PATENT DOCUMENTS

| | | | | |
|---|---|---|---|---|
| 5,916,087 | A | 6/1999 | Owens | |
| 6,330,815 | B1 * | 12/2001 | Duncan | 70/58 |
| D470,211 | S | 2/2003 | Redict | |
| 6,585,209 | B1 | 7/2003 | Mattingly | |
| 7,591,402 | B2 | 9/2009 | Rassias | |

* cited by examiner

BEDSIDE PISTOL SUPPORTING DEVICE

CROSS-REFERENCE TO RELATED APPLICATIONS

This application claims priority to U.S. Provisional Patent Application Ser. No. 61/362,096 filed on Jul. 7, 2010 titled "Bedside Pistol Supporting Device" and the disclosure of which is expressly incorporated herein.

BACKGROUND OF THE INVENTION

The present invention relates generally to firearm support systems and, more particularly, to a device for supporting an unholstered firearm proximate a bed and in an orientation that aligns the grip of the pistol with the palm of a user positioned in a customary sleeping position.

Many homeowners and renters appreciate the security that a firearm provides. Those skilled in firearm use and management also appreciate the susceptibility to home security during sleeping hours. In an effort to expedite access to firearms during security incidents, many firearm owners keep firearms in close proximity to sleeping quarters. Although many people simply place a firearm within close reach of a bed, such as supported on the floor or contained in a nightstand, such positioning can result in delay or difficulty in engaging the firearm during darkness and/or during startled waking events. In an effort to better access firearms during such events, others have configured systems for supporting firearms with the bed. Unfortunately, such systems are not without their respective drawbacks.

One such system includes a pair of slings that support a shotgun in a horizontal orientation adjacent the bed. Although such a system conveniently positions a shot gun for home security, many firearm users prefer the maneuverability and ability to better conceal a firearm that can only be achieved with a pistol. Hanging a shotgun or long barrel firearm along a mattress is generally a more obtrusive firearm support system than many users are willing to accept.

Other bedside firearm support systems are configured to support a pistol in close proximity to a mattress. Such systems also suffer from a number of drawbacks. One such system includes supporting a box with the structure of the bed. Such systems detract from the readiness of the pistol during emergency-type situations. Other systems do not enclose the pistol in a closure but cooperate with a holster rather than a firearm. Such systems require ownership of a holster associated with a particular pistol for the user to use such bedside mounting systems. Furthermore, the holster can interfere with expedited access to the pistol and/or interfere with the users gripping of the pistol during emergencies.

In certain circumstances, the holster can undesirably disengage from the bedside support via the interaction between the holster and the pistol. Commonly, two hands are required to disengage the pistol from the holster in a manner wherein the holster remains engaged with the support system and/or the separate manipulation of the pistol relative to the holster to disengage the pistol therefrom. In the most serious events, these fettered interactions between the pistol and the support system can have fatal consequences for a user via either undesired detection of their motions and/or inadvertent discharge of the firearm due to unexpected semiconscious interaction with the firearm.

Such bedside pistol support systems also fail to consider the orientation of the firearm relative to the user when the user is positioned in a prone position. Locating the pistol and moving to a position wherein the pistol can be gripped and/or removed from the holster and support system increases the potential that the user's movement may be detected by undesired or unknown nefarious observers, such as an intruder.

Therefore, it would be desirable to provide a bedside pistol support system that orients a pistol adjacent a bed in a manner wherein the pistol can be quickly grasped with reduced movement and in a manner wherein the pistol can be disengaged from the support system with reduced effort and preferably singlehandedly.

BRIEF DESCRIPTION OF THE INVENTION

The present invention provides a pistol supporting device that overcomes one or more of the drawbacks discussed above. The pistol supporting device includes a base and a support post. The base is shaped to be disposed between a mattress and a box spring so that, in use, the base is maintained in a generally horizontal orientation. The support post is constructed of a material that is softer than the material of the bore of a pistol and is preferably formed of a carbon fiber material. The support post is attached to the base and extends in a direction that crosses, but is not perpendicular to, a plane associated with the base. The support post is constructed to be received in a bore of a pistol and oriented to align a grip of the pistol with a palm of a prone user. The pistol support device provides a convenient and readily severable interface between supporting device and a pistol engaged therewith.

According to one aspect of the invention, a pistol supporting device is disclosed that includes a base having a generally flat shape and constructed to be disposed between a mattress and a box spring so that the base is maintained in a generally horizontal orientation. A tab extends from the base beyond a perimeter of mattress. A support post is attached to the tab and extends in a direction that crosses a plane associated with the base but is not perpendicular to the plane. The support post is constructed to be received in a bore of a pistol and oriented to align a grip of the pistol with a palm of a prone user.

Another aspect of the invention that is useable with one or more features of one or more of the above aspects discloses a bed pistol support assembly having a base plate that is configured to be disposed under a mattress and sized to support a pistol in a cantilevered fashion beyond a perimeter of the mattress. The assembly includes a carbon fiber post that extends in an upward direction from the base plate so that a pistol can be supported adjacent a lateral side of the mattress via interaction of only the carbon fiber post with a bore of the pistol.

A further aspect of the invention that includes one or more features useable with one or more of the above aspects discloses a method of supporting a pistol within the reach of a prone user on a bed that includes forming a base plate that is constructed to be disposed between a mattress and a box spring of a bed and attaching a carbon fiber post to the base plate so that the carbon fiber post extends in a direction having a vertical component and a horizontal component from the base plate when the base plate is positioned under the mattress.

Preferably, the support post of the devices disclosed above is constructed of a material that is softer than a material of the bore of the pistol. More preferably, the support post is constructed of a carbon fiber material. Preferably, the tab associated with the support post is tipped with respect to the plane of the base and more preferably, the support post is tipped in first direction aligned with a longitudinal axis of the bed and is tipped in a second direction that is normal to the longitudinal direction or in a direction toward the mattress of the supporting bed assembly. More preferably, the first direction is determined by the user based on their preferred or most common sleeping orientation, i.e. face up or face down.

These and various other features and advantages of the present invention will be made apparent from the following detailed description and the drawings.

BRIEF DESCRIPTION OF THE DRAWINGS

The drawings illustrate preferred embodiments presently contemplated for carrying out the invention.

DETAILED DESCRIPTION OF THE PREFERRED EMBODIMENT

Figure 1:
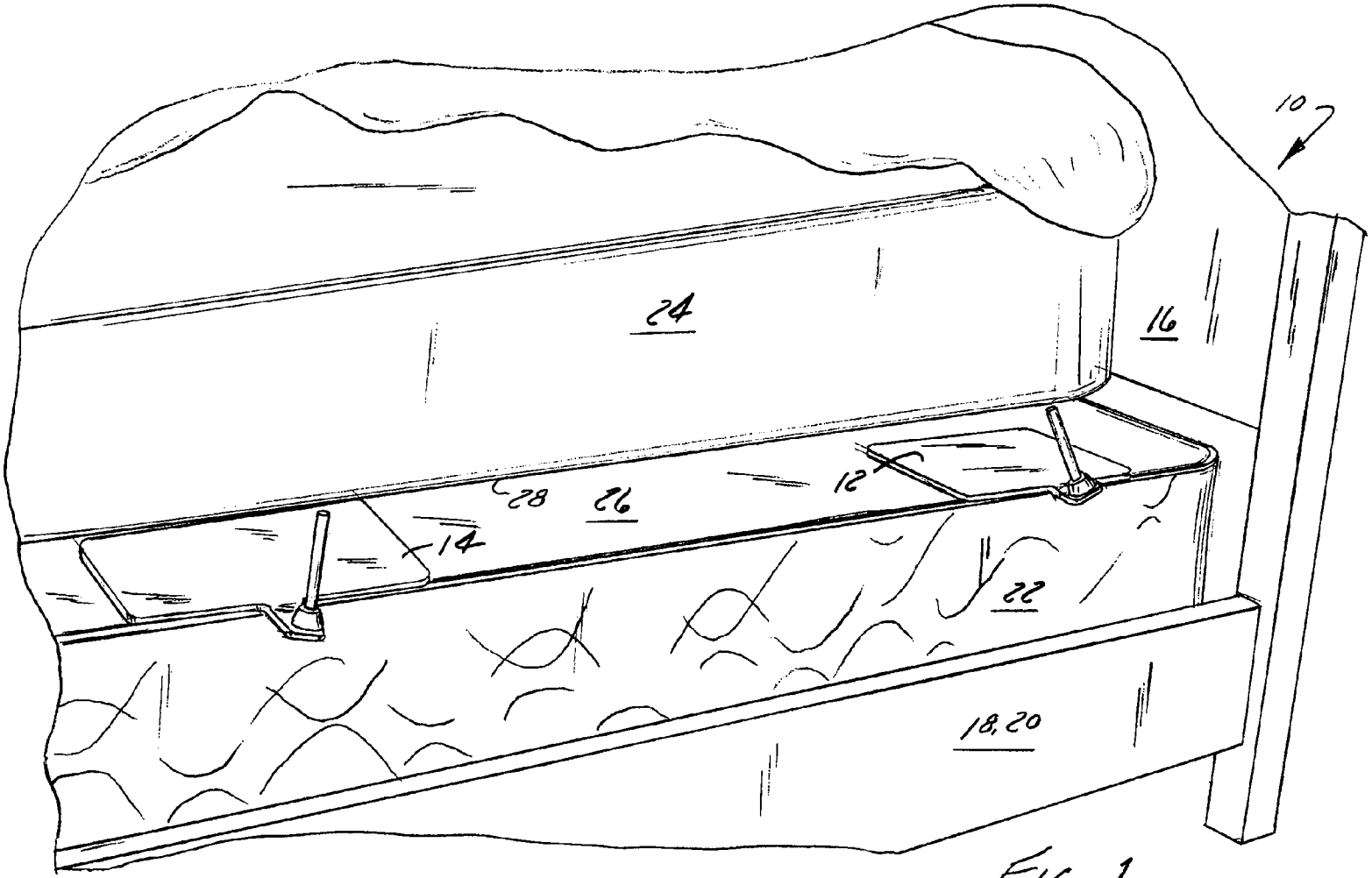
FIG. 1 is a perspective view of a portion of a bed equipped with a pair of pistol supporting devices and with the mattress laterally offset from a normal in use position aligned with a box spring to expose an upper side of the pair of pistol supporting devices.
Figure 2:
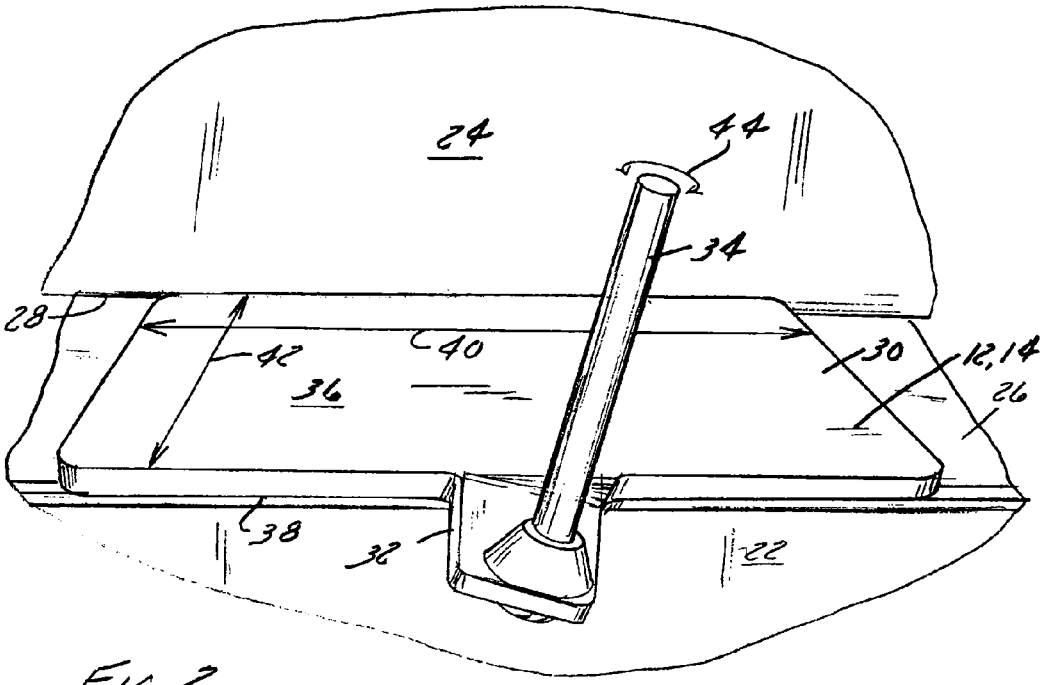
FIG. 2 is a view similar to FIG. 1 of one of the pistol supporting devices that orients the grip of a corresponding pistol in a direction that inclines toward the headboard of a bed.
Figure 3:
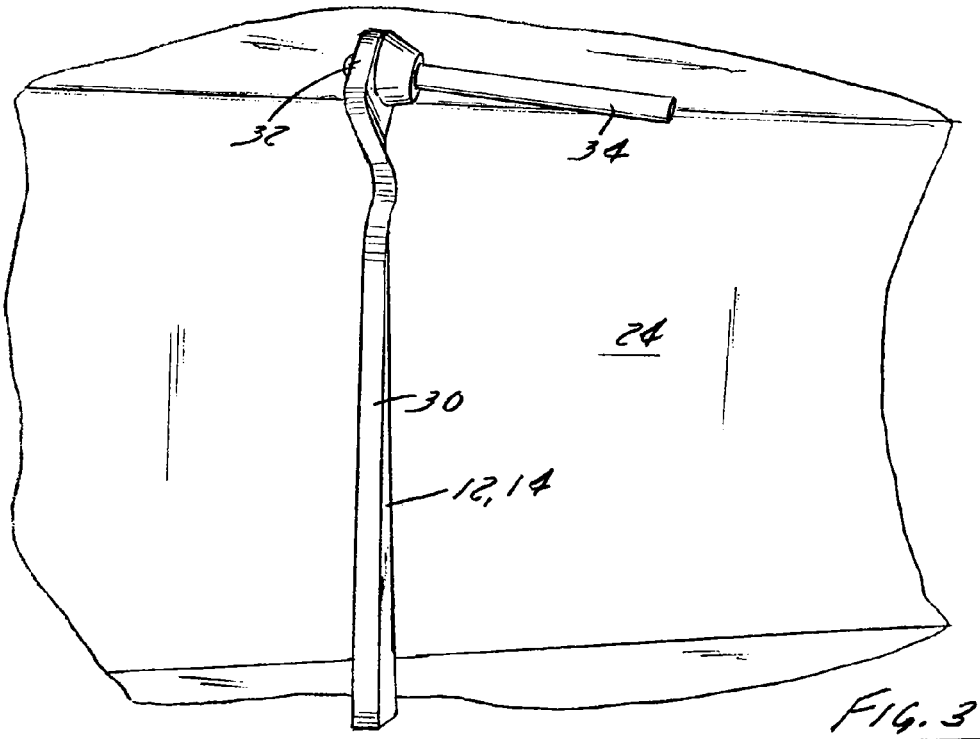
FIG. 3 is a side view of the pistol supporting device shown in FIG. 2 oriented in an upstanding orientation relative to a mattress.
Figure 4:
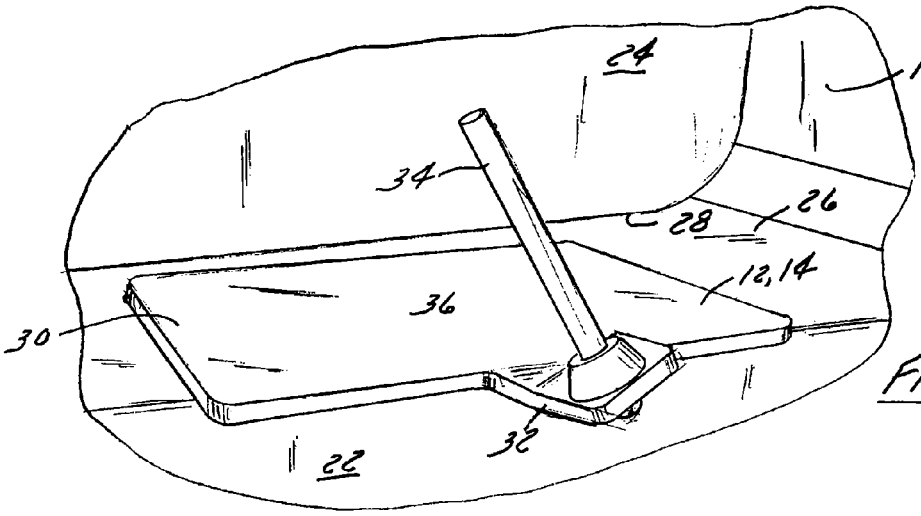
FIG. 4 is a view similar to FIG. 2 of the other pistol supporting device that orients the grip of a corresponding pistol in a direction that inclines toward the footboard of a bed.
Figure 5:
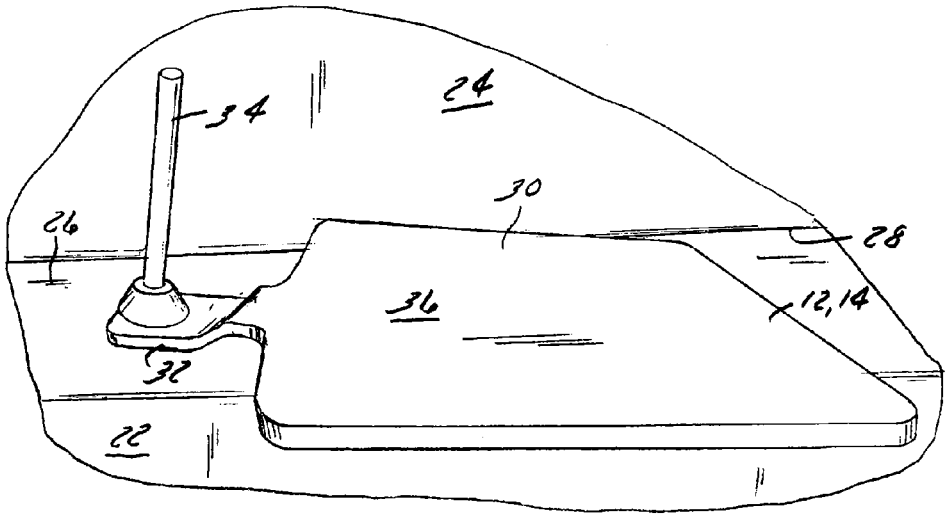
FIG. 5 is a perspective view of a lateral side of the pistol supporting device shown in FIG. 4.

FIG. 1 shows a bed 10 equipped with a first pistol support assembly 12 and a second pistol support assembly 14. Bed 10 includes a headboard 16, a footboard, and a pair of side rails 18, 20 that extend therebetween. It is appreciated that pistol support assemblies 12, 14 are usable with bed configurations that only include a mattress and supporting structures such as a floor, a box spring, and/or other frame assemblies that may or may not include a headboard and/or a footboard. As used herein, the terms headboard and footboard are used more so to orient one or more of support assemblies 12, 14 relative to a head and toe orientation of a user of bed 10. It is further appreciated that either of support assemblies 12, 14 could be positioned anywhere around the perimeter of bed, including the longitudinal sides as shown in the figures or at the head or foot of the bed as preferred by a user. Still referring to FIG. 1, bed 10 preferably includes a box spring 22 or other mattress support that is disposed between the headboard 16, the footboard, and the pair of side rails 18, 20. A mattress 24 generally overlies box spring 22. Referring to FIGS. 1-2, box spring 22 includes an upper surface 26 that is oriented to face a bottom surface 28 of mattress 24. Pistol support assemblies 12, 14 each include a base portion 30, a tab or arm portion 32, and a support post 34 that extends in a crossing direction from the based portion 30. As explained further below, each support post 34 is constructed to slideably cooperate with the bore of a pistol.

Base portion 30 includes an upper surface 36 that faces underside 28 of mattress 24 and a bottom surface 38 that faces top surface 26 of box spring 22. Base portion 30 has a length 40 and width 42 that are sufficiently dimensioned to prevent rotation, indicated by arrow 44, of support post 34 and base portion 30 relative to bed 10 when base portion 30 is positioned between box spring 22 and mattress 24.

Referring to FIGS. 2-5, arm portion 32 of base portion 30 lies in a plane that is oriented in a crossing direction with respect to a plane defined by base portion 30. Support post 34 extends in a generally upward direction with respect to top surface 36 of base portion 30. Preferably, a longitudinal axis of support post 34 is tilted with respect to top surface 36 of base portion 30 so as to be nearer an axis that is perpendicular to top surface 36 of base portion than to an axis generally aligned with the longitudinal plane of surface 36. Preferably, support post 34 is tilted approximately 20 degrees from vertical toward either of the headboard or the footboard of the bed 10. It is appreciated that the inclined orientation of support post 34 relative to base portion 30 can be selected as any degrees in the quadrants whose axis is defined by the plane associated with based portion 30. Preferably, the longitudinal axis of support post 34 is oriented to be at least slightly tipped with respect to a horizontal axis such that the weight of a firearm is sufficient to maintain a position of the firearm when engaged with a corresponding support post. More preferably, each support post is oriented so that the weight of the firearm maintains the desired engagement with the support post and so that the grip of the firearm is generally aligned with an orientation wherein a prone user, positioned one of on their back or their stomach, can interact with the grip of the pistol in an unstrained and non-exerting manner. It is appreciated that support post 34 associated with arm 32 of base 30 can be angled at any degree desired to support a firearm laterally and longitudinally relative to top surface 36. Regardless of the orientation and construction of support assembly 12, 14, no portion of support assembly 12, 14 interacts with or contacts the firing and/or safety mechanism of a firearm engaged therewith.

With respect to a lateral direction that extends between the right hand and left hand sides of bed 10, although support post 34 can be oriented in a plane generally perpendicular to surface 36 of base portion 30, it is also envisioned that support post 34 preferably be tilted toward mattress 24 in the lateral direction. It is appreciated that support post 34 associated with arm 32 can be angled at any lateral and longitudinal angle to provide the desired close proximity to mattress 24 when a firearm is engaged or removed therefrom while maintaining a convenient positioning of post 34 for interaction of a firearm therewith and to provide a desired orientation of the grip of the firearm for expedient user interaction therewith. Preferably, support post 34 is tilted in the lateral direction approximately about 20 degrees and more preferably about 12 degrees in a lateral direction toward mattress 24. Such tilting maintains the grip portion of the firearm engaged with support assembly 12, 14 in very near or direct contact with mattress 24 while maintaining an easily concealable orientation of the firearm relative to the bed and a non-obtrusive orientation of the respective support assembly 12, 14 when no firearm is engaged therewith.

Figure 6:
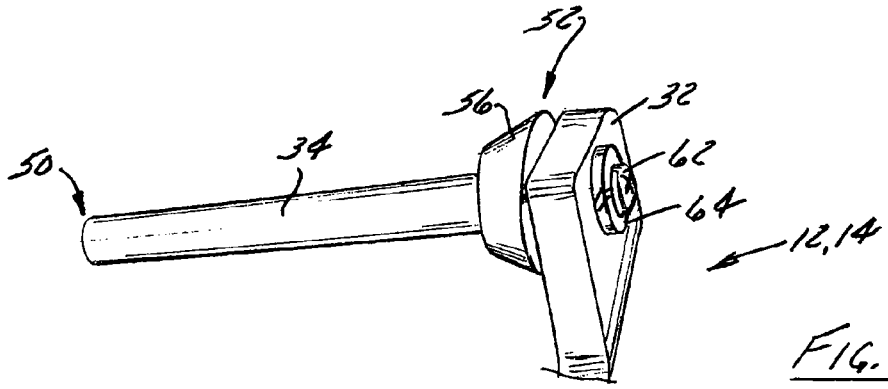
FIG. 6 is a perspective view of a post portion of one of the pistol supporting devices shown in FIG. 1.
Figure 7:
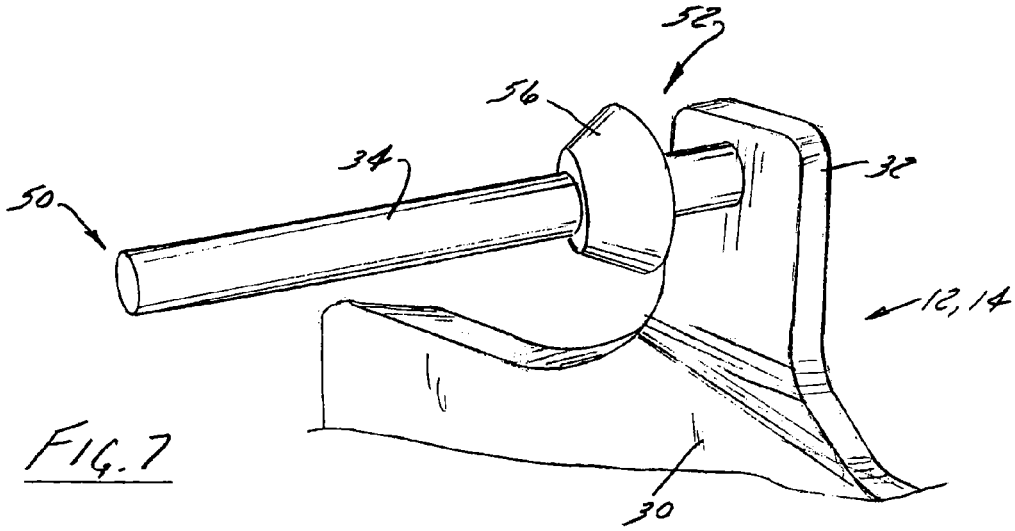
FIG. 7 is a view similar to FIG. 6 with a muzzle bumper of the pistol supporting device translated along a bore engaging shaft of the device.
Figure 8:
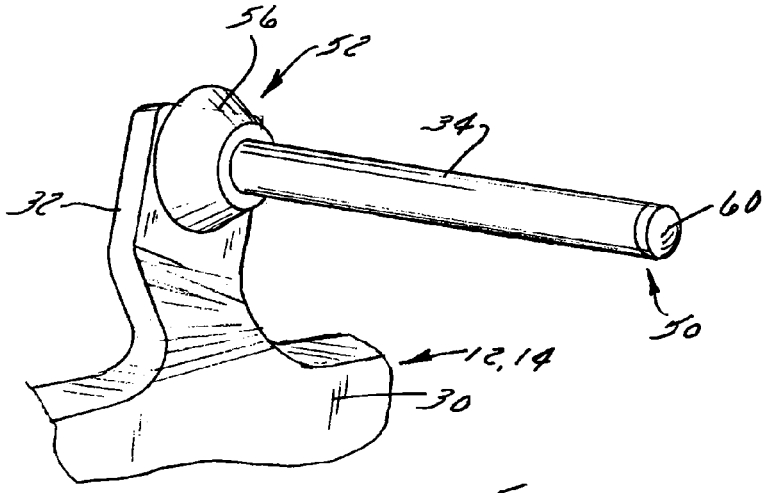
FIG. 8 is a perspective view of another embodiment of the bore shaft shown in FIG. 6.
Figure 9:
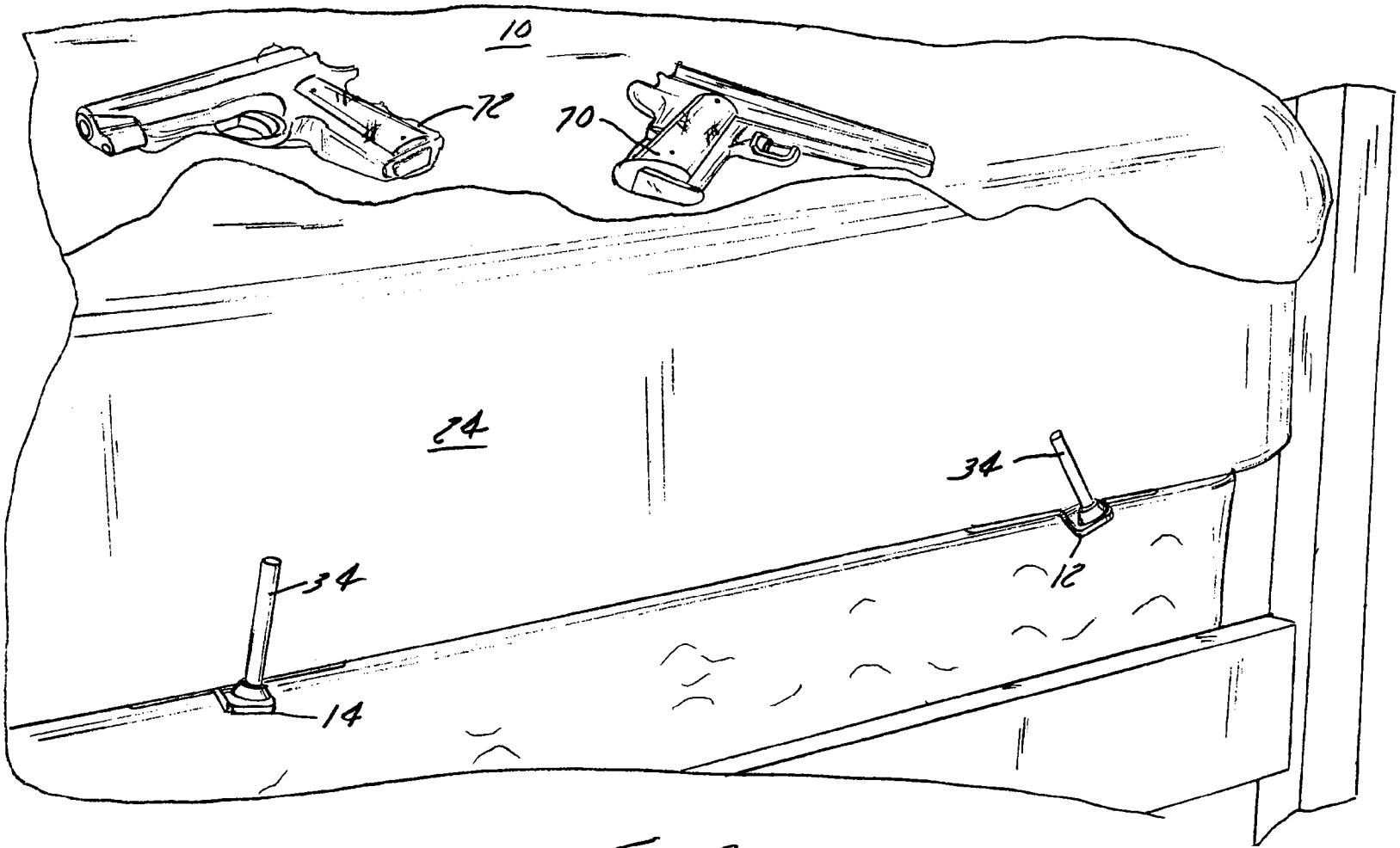
FIG. 9 is a view similar to FIG. 1 and shows the mattress in a normal in-use position such that a portion of the pistol supporting devices as supported between the mattress and boxspring of the bed and another portion extends in a generally upward direction along the vertical edge of the mattress.

Referring to FIGS. 6-8, each support post assembly 34 includes a bore end 50 and a base end 52. Support post 34 is preferably constructed a carbon fiber material although it is also envisioned that support post 34 could be constructed of other materials such as aluminum. It is further envisioned that post 34 could be constructed of any of a number of materials. Preferably, support post 34 is constructed of a material that is softer than the bore of a firearm. Understandably, support post 34 can be constructed of virtually any material. It is further envisioned that support post 34 can have a two part construction wherein only a radially exterior portion of support post 34, or that portion of support post 34 that directly contacts the firearm, be constructed of sacrificial material relative to the firearm bore.

An optional bumper 56 slidably cooperates with support post 34 and prevents the interaction of a firearm muzzle with the arm 32 of base portion 30 of firearm support assemblies 12, 14. Preferably, support post 34 has a longitudinal length that is sufficient to support a firearm thereon so that the muzzle can interact with bumper 56. Understandably, other barrel lengths will allow the support post 34 to interact with different structures of the firearm. Preferably, the support post 34 is not long enough to interact with a shell that may be in the firing chamber and/or the action of the firearm. Preferably, a bumper 60 is engaged with a bore end 50 of support post 34 and reduces the potential of inadvertent damage to such structures of the firearm.

Referring to FIG. 6, a fastener 62 passes through an opening formed in arm portion 32 of firearm support assembly 12, 14 and threadingly engage a base end 52 of support post 34. An optional lock washer 64 is disposed between a head portion of fastener 62 and base portion 30 of the respective support assembly 12, 14. Lock washer 64 reduces the potential for undesired disengagement between fastener 62 and the respective post 34. Fastener 62 secures support port 34 with respect to base portion 30. The removable nature of support post 34 further allows firearm support assembly 12, 14 to be provided in a generally compact form factor thereby reducing distribution costs. That is, it is envisioned that support assembly 12 can be provided to consumers in a fairly flat form factor favorable to most commercial distribution systems. Furthermore, the canting of arm portion 32 need only be provided in two configurations to satisfy user's preferences for use of assemblies 12, 14 at both right hand or left hand sides of the bed and provide both headboard facing or footboard facing orientations of a corresponding firearm. As should be understood, a footboard facing muzzle orientation of the bedside pistol support on one side of the bed will provide a headboard facing muzzle orientation if the bedside pistol support is engaged with the opposite lateral side of the bed.

Figure 10:
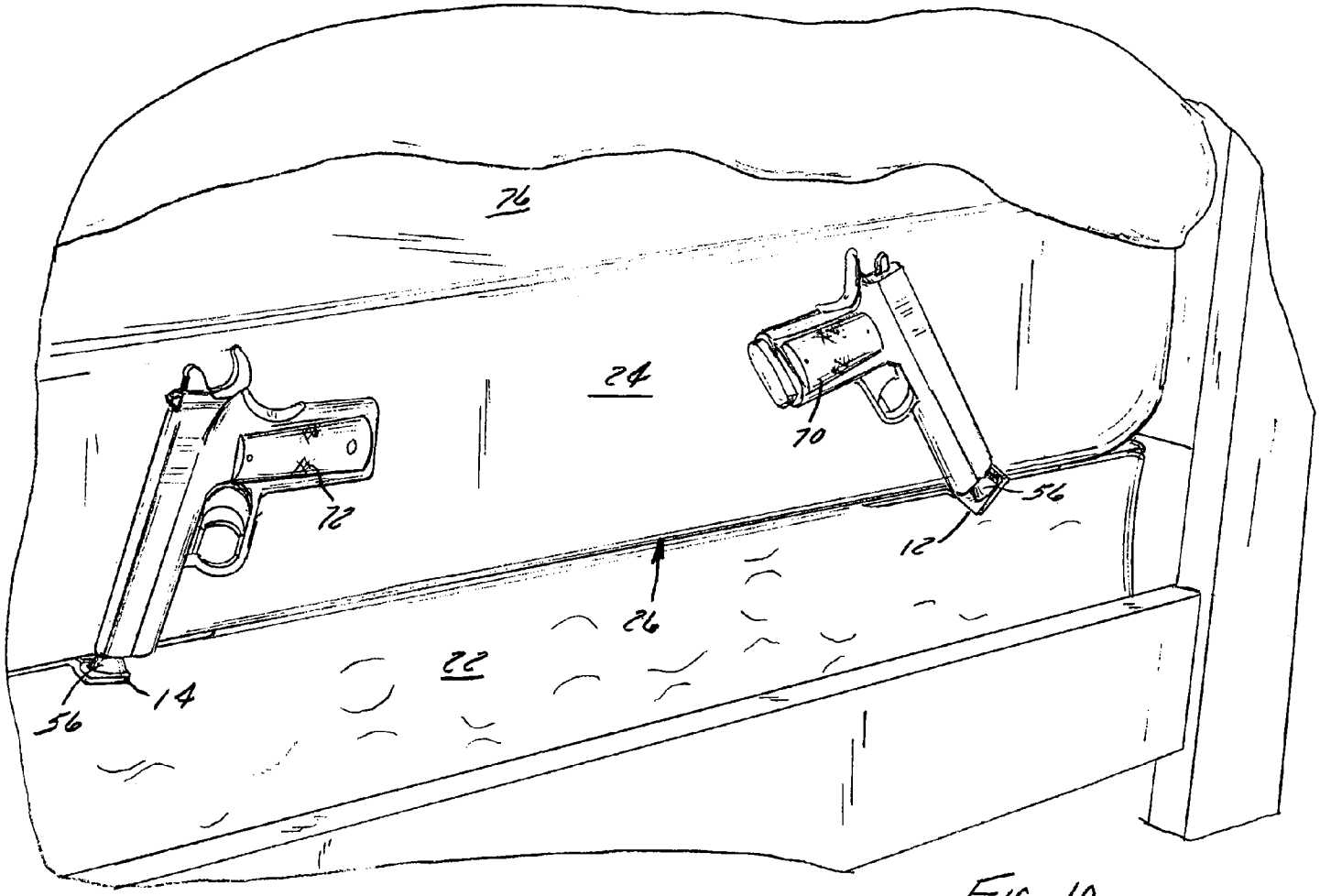
FIG. 10 is a view similar to FIG. 9 and shows a pistol engaged with each pistol supporting device.
Figure 11:
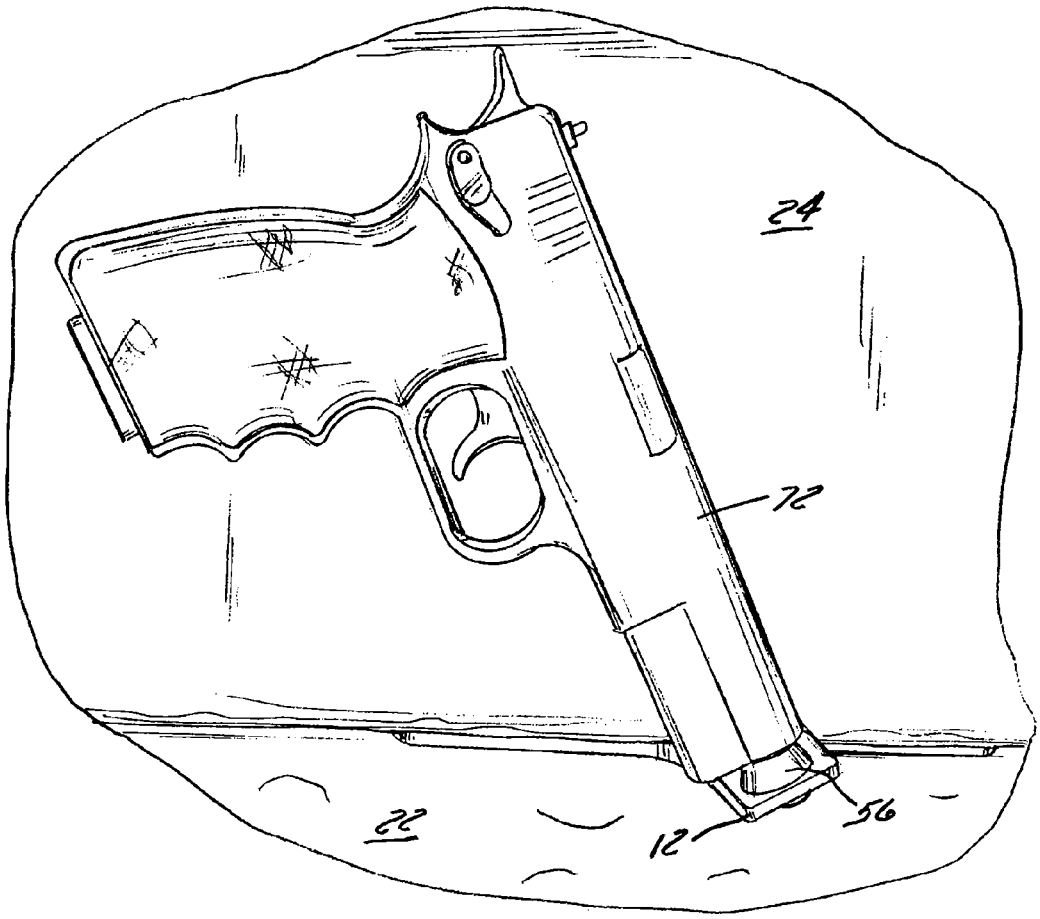
FIG. 11 is a side elevation view of a pistol engaged with the pistol supporting device shown in FIG. 4.
Figure 12:
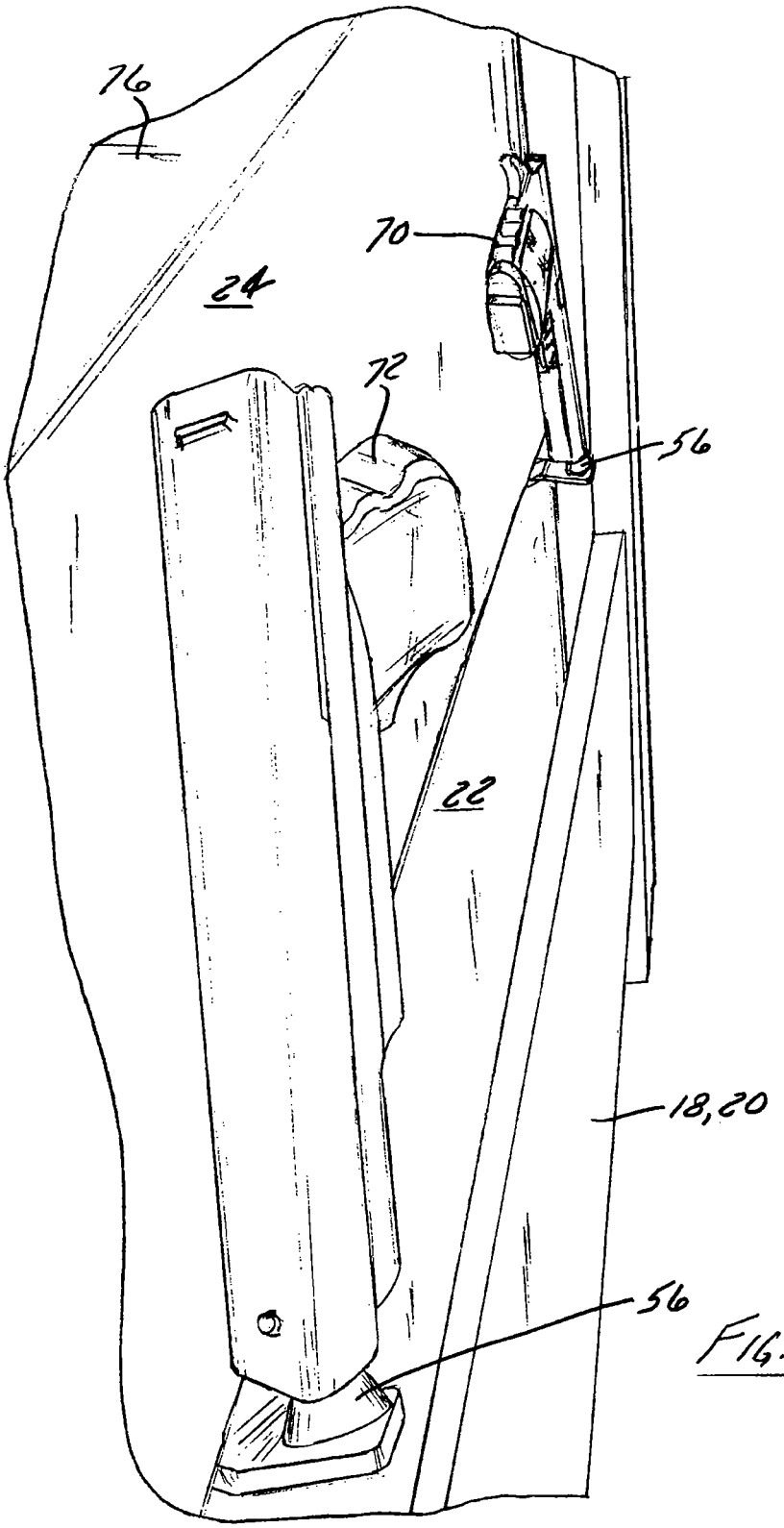
FIG. 12 is a side perspective view of the pistol supporting configuration shown in FIG. 10.
Figure 13:
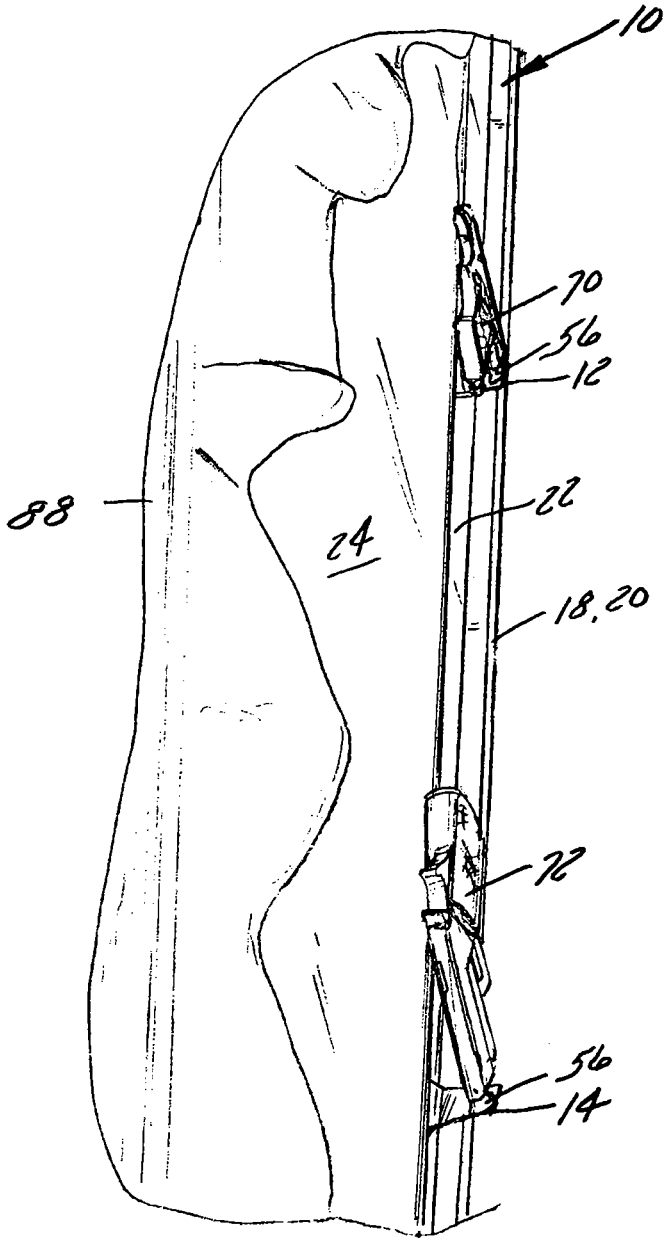
FIG. 13 is a top perspective view of the pistol supporting configuration shown in FIG. 10.
Figure 14:
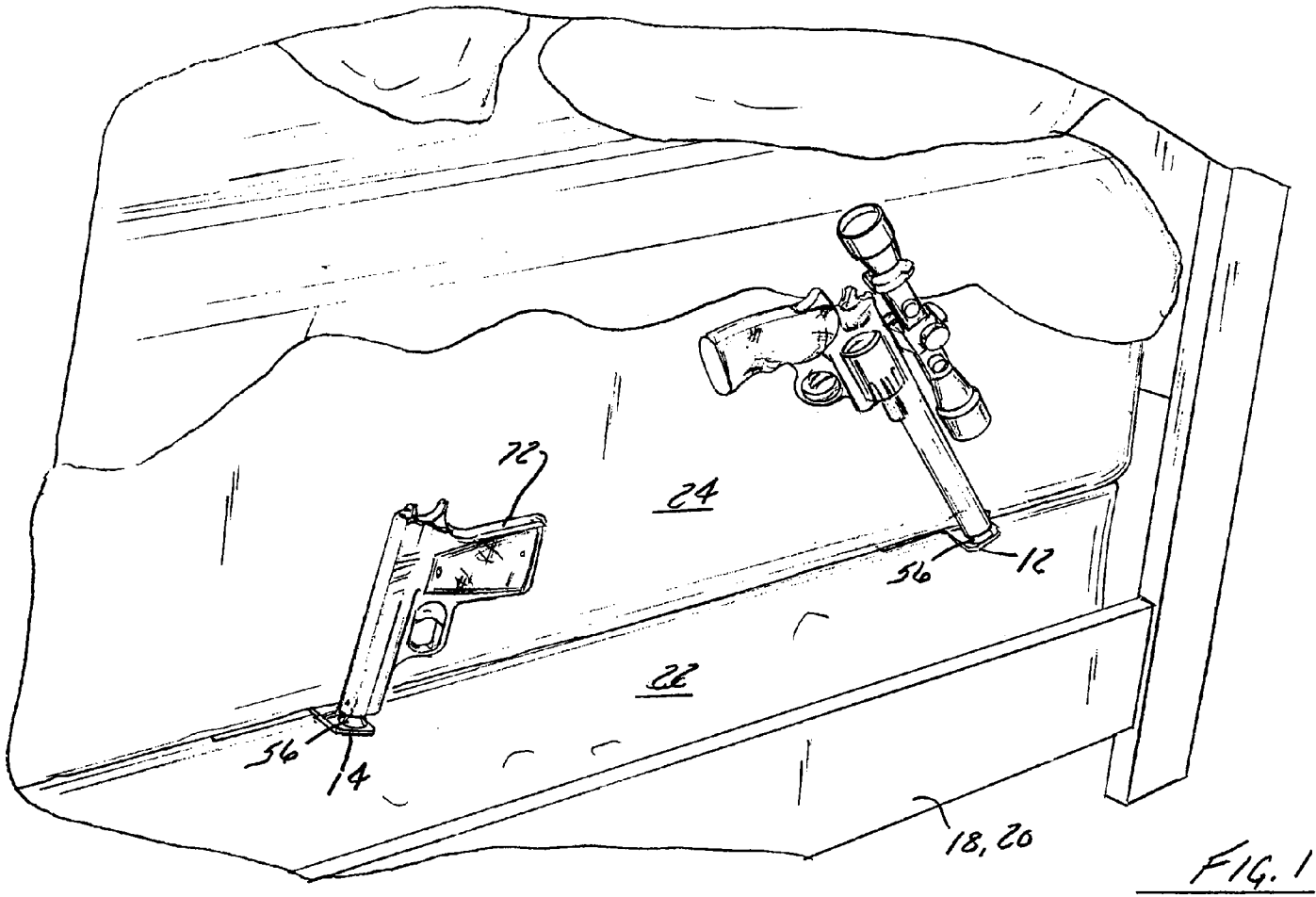
FIG. 14 is a view similar to FIG. 10 and shows a pistol equipped with a scope engaged with at least one of the pistol supporting devices shown in FIG. 10.

FIGS. 9-21 show pistol support assemblies 12, 14 positioned with respect to bed 10 for supporting one or more pistols 70, 72 in a "ready-to-use" position relative thereto. Support post 34 extends in a generally upward direction in close lateral proximity to mattress 24. As shown in FIG. 10, in a preferred embodiment, pistols 70, 72 supported by pistol support assemblies 12, 14 do not extend beyond the top surface 76 of mattress 24 or considerably beyond top surface 26 of box spring 22. As shown in FIG. 13, bedside supported firearms 70, 72 are maintained in close lateral proximity to mattress 24 so as to preferably not extend beyond side rails 18, 20 of bed 10. As shown in FIG. 14, certain firearms, such as longer barreled pistols 78, may still be used with firearm support assemblies 12, 14 even though such firearm configurations can extend nearer to or beyond the upper surface of mattress 24. It is appreciated that the bedside pistol support assemblies 12, 14 can cooperate with any side of the periphery of the bed.

Figure 15:
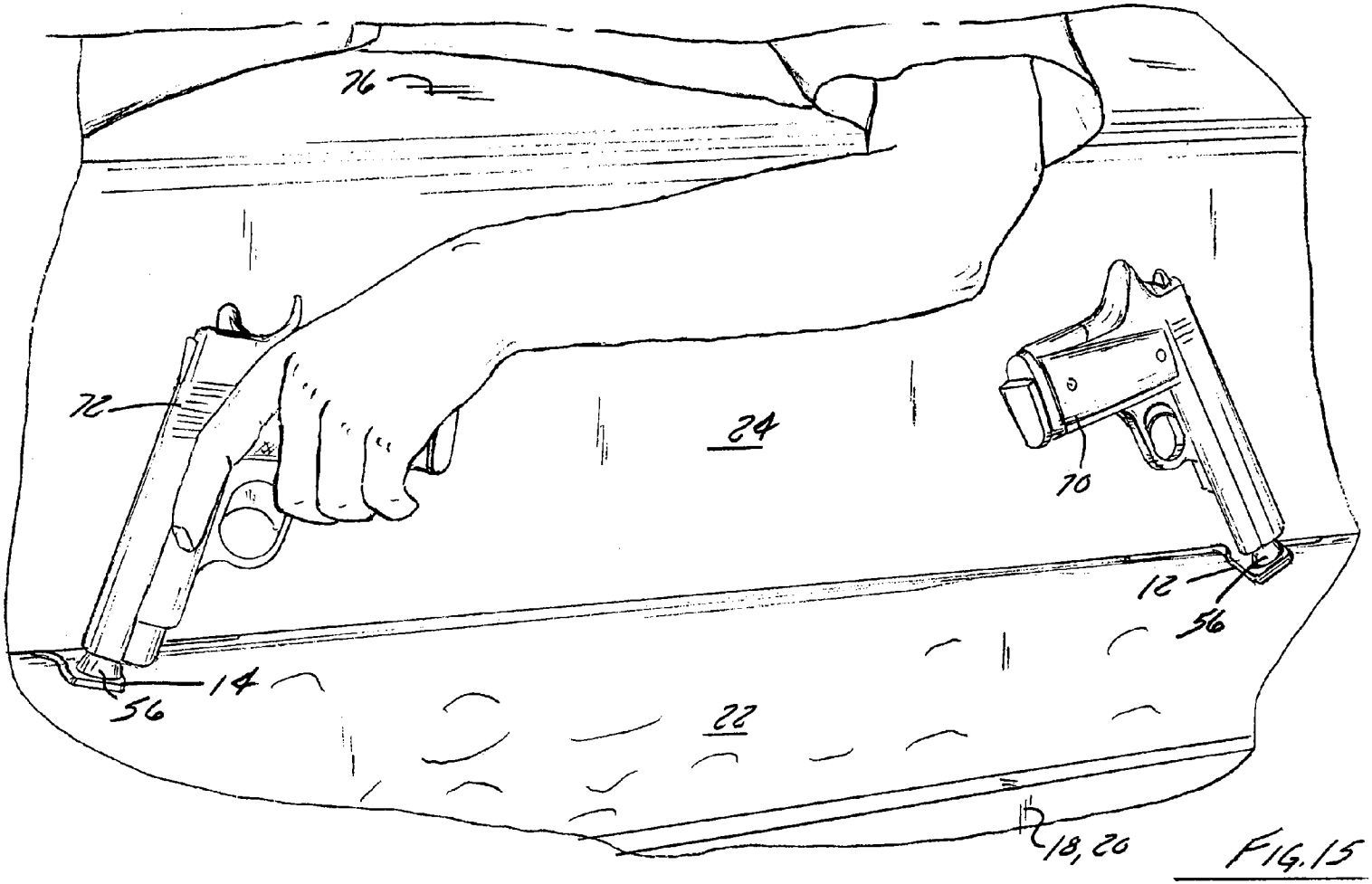
FIG. 15 is a view similar to FIG. 10 and shows the hand of a back resting user engaged with a grip of the pistol supported nearer the footboard of the bed.
Figure 16:
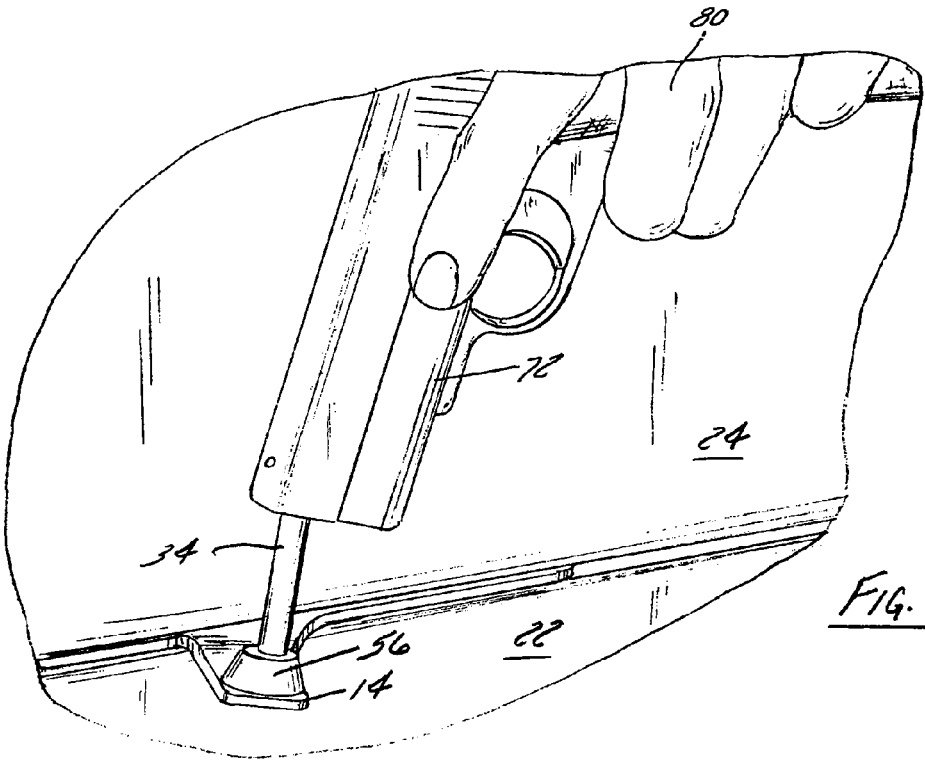
FIG. 16 is a view similar to FIG. 15 and shows a slight upward translation of the pistol relative to the pistol supporting device.

Referring to FIGS. 15-18, firearms 70, 72 are positioned in close proximity to mattress 24 so as to be readily reachable by a user positioned upon bed 10. As shown in FIG. 15, pistol support assembly 14 is oriented so that firearm 72 cants or is tipped in a direction toward the headboard relative to a vertical axis so that the grip of the pistol is oriented with respect to a grip of a prone user lying on their back. Upward translation of pistol 72 relative to support post 34 allows user 80 to quickly and inconspicuously remove pistol 72 from bedside pistol support assembly 14.

Figure 17:
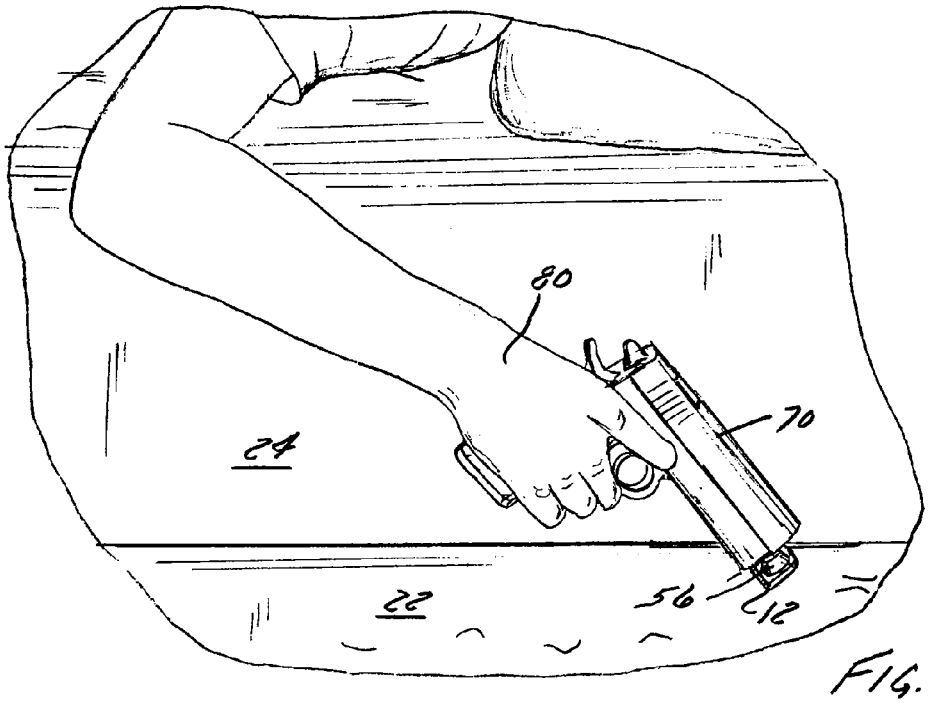
FIG. 17 is a view similar to FIG. 10 and shows the hand of a stomach resting user engaged with a grip of the pistol supported nearer the headboard of the bed.
Figure 18:
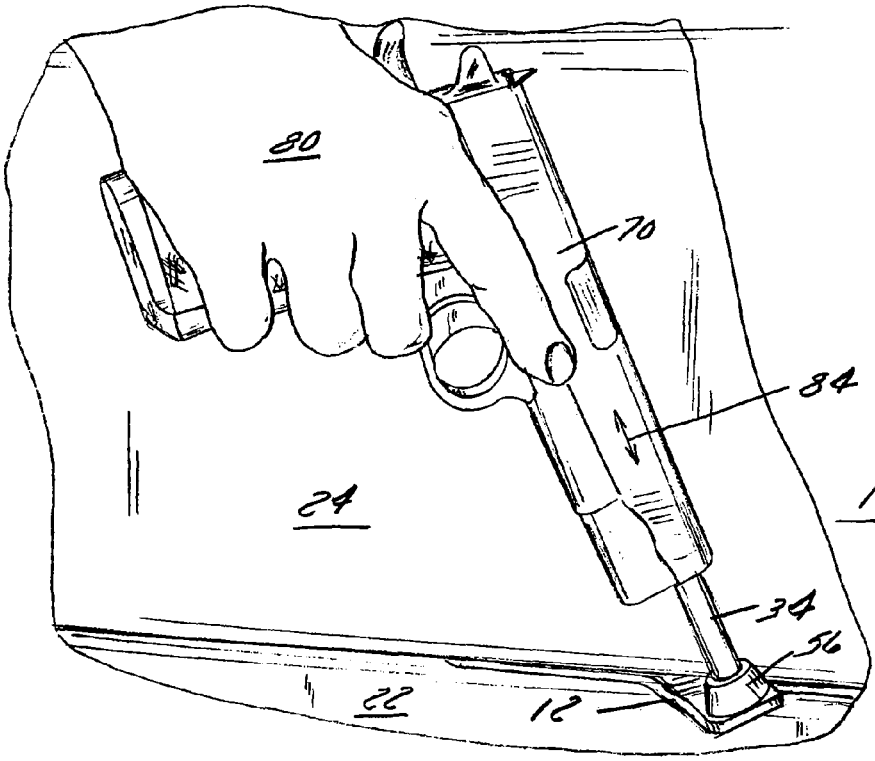
FIG. 18 is a view similar to FIG. 17 and shows a slight upward translation of the pistol relative to the pistol supporting device.
Figure 19:
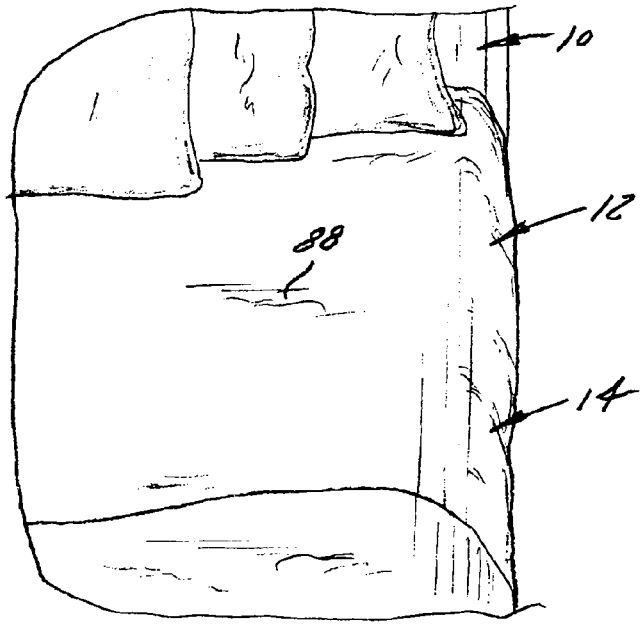
FIGS. 19-21 are views similar to FIGS. 10 and 14 and show various common bedcoverings and bedcover positions wherein the bedcoverings; be it a comforter, blanket, or sheet; extend over and conceal the respective pistol(s) and corresponding pistol support device(s).
Figure 20:
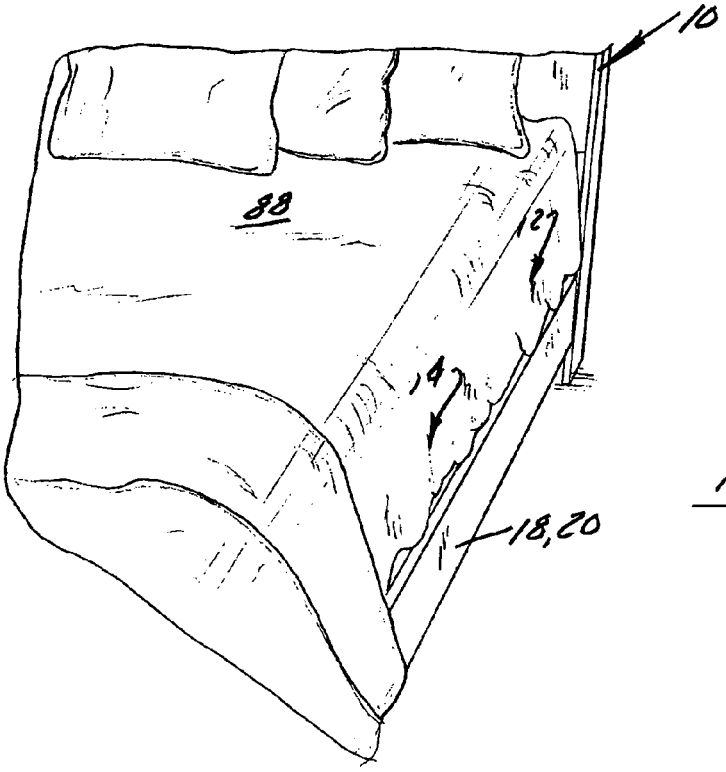
Figure 21:
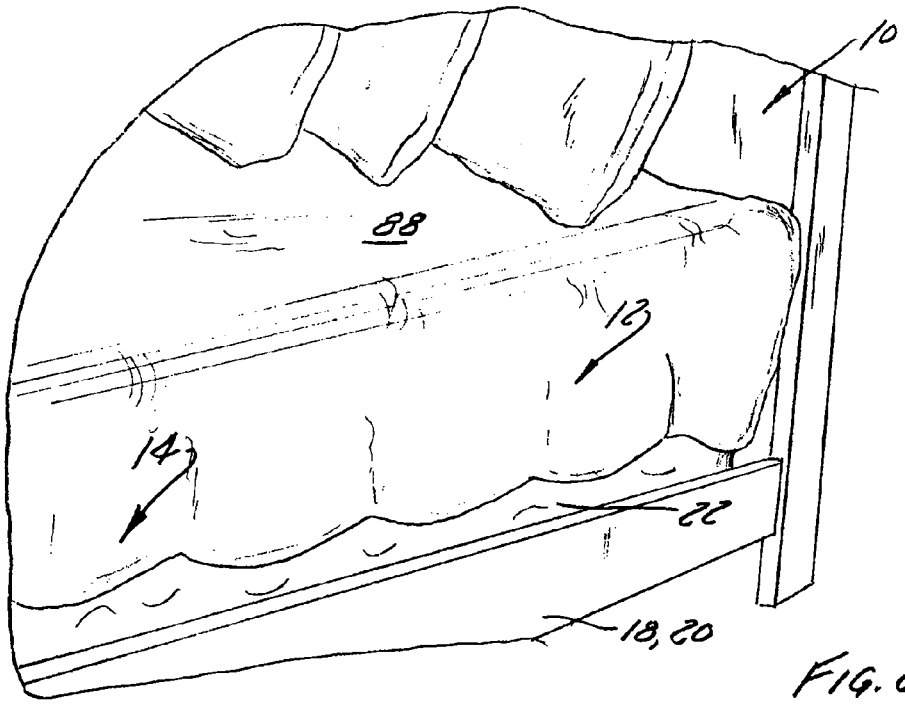

Referring to FIGS. 17 and 18, for those users that are prone to sleeping on their sides and/or stomachs so as to be positioned generally facing mattress 24, pistol support assembly 12 is oriented to align the grip of the pistol with the grip of a downward or side facing, generally forward reaching user 80. Vertical translation, indicated by arrow 84, of pistol 70 along support post 34 of pistol support assembly 12 allows a downward facing user to readily and inconspicuously interact with firearm 70. As shown in FIGS. 19-21, bedside pistol support assemblies 12, 14 having pistols engaged therewith, are readily concealable by a bedspread 88 or other bed coverings, such as a sheet, positioned thereover. The unobtrusive nature of the concealed pistol and pistol support assemblies 12, 14 is readily appreciable from FIGS. 19-21 wherein no discernible discontinuity is visible in bedspread 88.

Bedside pistol support assemblies 12, 14 provide for "at-the-ready" positioning of pistols with respect to bed 10. Supporting the pistol via only interaction with the bore of the firearm and with a structure whose position is robustly maintained by the considerable weight associated with a mattress provides a bedside support system that allows expedient interaction with the pistol engaged therewith. The variable orientation of the pistol allows a user in a variety of sleeping positions to inconspicuous interact with the firearm. Furthermore, bedside pistol support 12, 14 prevent across-room access to firearms when users are sleeping. That is, it is envisioned that pistol supports 12, 14 can be conveniently positioned at a location convenient for expedient user use of the firearm while maintaining a maximum positioning of the firearm from unknown third parties.

It is further envisioned that support assemblies 12, 14, or portions thereof, can be utilized for supporting other accessories in close proximity to furniture or the like. For instance, it is envisioned that a bracket rather than or in addition to support post 34 could be connected to tab 32 of base portion 30 of support assembly 12, 14. Such a bracket could be configured for cooperation with other accessories such as glass cases, books, containers for remote controls such as television, electronics, security system, or lighting remotes, etc. It is further envisioned that such a bracket could form either a covered or uncovered container for receiving such accessories. It is further envisioned that such a bracket could be configured to cooperate in a supporting manner with the accessory itself, such as post 34 cooperates with firearm 70, 72 or with a container commonly associated with such accessories. Due to the contact nature of support assemblies 12, 14 it is further envisioned that more than one support assembly can be engaged with the same furniture structure for supporting multiple different accessories.

Therefore one embodiment of the invention includes a pistol supporting device having a base with a generally flat shape and constructed to be disposed between a mattress and a box spring so that the base is maintained in a generally horizontal orientation. A tab extends from the base beyond a perimeter of mattress. A support post is attached to the tab and extends in a direction that crosses a plane associated with the base but is not perpendicular to the plane. The support post is constructed to be received in a bore of a pistol and oriented to align a grip of the pistol with a palm of a prone user.

Another embodiment of the invention that is useable in combination with one or more features of the above embodiment includes a bed pistol support assembly having a base plate that is constructed to be disposed under a mattress and sized to support a pistol in a cantilevered fashion beyond a perimeter of the mattress. The assembly includes a carbon fiber post that extends in an upward direction from the base plate so that a pistol can be supported adjacent a lateral side of the mattress via interaction of only the carbon fiber post with a bore of the pistol.

Another embodiment of the invention that is useable in combination with one or more of the features of the above embodiments includes a method of supporting a pistol within the reach of a prone user on a bed that includes forming a base plate that is constructed to be disposed between a mattress and a box spring of a bed. The method includes attaching a carbon fiber post to the base plate so that the carbon fiber post extends in a direction having a vertical component and a horizontal component from the base plate when the base plate is positioned under the mattress.

The present invention has been described in terms of the preferred embodiment, and it is recognized that equivalents, alternatives, and modifications, aside from those expressly stated, are possible and within the scope of the appending claims.

What is claimed is:

1. A pistol supporting device comprising:

a base having a generally flat shape and constructed to be disposed between a mattress and a box spring so that the base is maintained in a generally horizontal orientation;

a tab that extends in a substantially horizontal direction from the base beyond a perimeter of mattress;

a support post attached to the tab and extending in a direction that crosses a plane associated with the base but is not perpendicular to the plane and so that the support post does not overlie a vertical footprint of the base, the support post constructed to be received in a bore of a pistol and oriented so that the pistol does not overlie a vertical footprint of the base and uninterruptably slidably cooperates with the support post and aligns a grip of the pistol with a palm of a prone user.

2. The pistol supporting device of claim 1 wherein the support post is constructed of a material that is softer than a material of the bore of the pistol.

3. The pistol supporting device of claim 1 wherein the support post is constructed of a carbon fiber material.

4. The pistol supporting device of claim 1 wherein a face of the tab that engages the support post is tipped with respect to the plane of the base.

5. The pistol supporting device of claim 1 wherein the support post extends from the tab in an upward direction and is tipped toward at least two of a headboard area, a footboard area, a right hand side, and a left hand side of the mattress.

6. The pistol supporting device of claim 1 wherein the support post extends from the tab in a lateral direction toward the mattress as it extends away from the tab.

7. A bed pistol support assembly comprising:

a base plate configured to be disposed under a mattress and sized to support a pistol in a cantilevered fashion beyond a perimeter of the mattress;

a carbon fiber post having a unitary cross-sectional shape along an entire length of the carbon fiber post, the carbon fiber post extending in an upward direction from the base plate so that a pistol can be supported adjacent a lateral side of the mattress via slidable interaction of only the carbon fiber post with a bore of the pistol and so that the pistol is always removable from the carbon fiber post via slidable translation of the pistol relative to the carbon fiber post;

another base plate that is also configured to be disposed under the mattress and sized to support another pistol in a cantilevered fashion beyond a perimeter of the mattress, the another base plate having another carbon fiber post configured to support the another pistol; and wherein the carbon fiber post and another carbon fiber post are oriented along crossing axis.

8. The bed pistol support assembly of claim 7 wherein the carbon fiber post is connected to a tab that extends from the base plate.

9. The bed pistol support assembly of claim 7 wherein the tab is pitched relative to the base plate.

10. The bed pistol support assembly of claim 7 wherein the carbon fiber post is shorter than a bore of pistol so that a muzzle of the pistol abuts the tab and the carbon fiber post terminates short of a round of ammunition disposed in a firing chamber of the pistol when the pistol is engaged with the carbon fiber post.

11. The bed pistol support assembly of claim 7 wherein the carbon fiber post is longer than the bore of the pistol to maintain a gap between a muzzle and the tab and the gap is sized to receive a bumper slidably associated with the carbon fiber post.

* * * * *